United States Patent [19]

Lobb

[11] 4,042,064

[45] Aug. 16, 1977

[54] PLATFORM STRUCTURE

[76] Inventor: George W. Lobb, 110 N. Shaver, Pasadena, Tex. 77506

[21] Appl. No.: 657,756

[22] Filed: Feb. 13, 1976

[51] Int. Cl.[2] ..... E06C 7/16

[52] U.S. Cl. ..... 182/115; 182/223

[58] Field of Search ..... 182/115, 119, 118, 179, 182/178, 223, 129; 52/300, 301, 721, 299

[56] References Cited

U.S. PATENT DOCUMENTS

| | | | |
|---|---|---|---|
| 2,726,123 | 12/1955 | Mathews | 182/113 |
| 3,250,401 | 5/1966 | Davidson | 182/178 |
| 3,307,653 | 3/1967 | Gnehm | 182/115 |
| 3,477,184 | 11/1969 | Johnson | 52/105 |

*Primary Examiner*—Reinaldo P. Machado
*Attorney, Agent, or Firm*—Pravel, Wilson & Gambrell

[57] ABSTRACT

A platform structure adapted for rapid assembly and a method of assembling the platform structure. A plurality of prefabricated column assemblies are removably anchored on a platform foundation, and prefabricated landing assembly means are removably mounted with the column assemblies to form a landing above the platform foundation. Subsequently, a stair assembly is removably mounted between the landing assembly means and the platform foundation to provide a passageway permitting ingress and egress to the landing.

1 Claim, 5 Drawing Figures

PLATFORM STRUCTURE

BACKGROUND OF THE INVENTION

The field of this invention is platform structures and methods of assembling such structures.

Platform structures have a variety of uses, one of which is providing a structure for gaining access to railroad cars to inspect, load, unload, or perform other operations involving the railroad cars. Many times it is necessary to gain access to the top of the railroad car. Accordingly, it is often desirable to have elevated platforms at loading and inspection stations in rail yards so that personnel have a structure permitting easy and safe access to appropriate parts of the cars. It is also desirable, of course, that the platform can be constructed with a minimum expenditure of time and labor. Further, the desired locations of loading and inspection stations in rail yards sometimes change, thus making it further desirable that the platform can be disassembled and subsequently reassembled at a different location with minimum expenditures of time, labor, and new material costs.

Platforms were available in the past, but often they did not possess the desirable features discussed above. Typically, the components of the platforms were welded or otherwise permanently affixed to each other. This characteristic of the platforms resulted in high assembly costs because of the extensive requirement of skilled workers, such as welders. Further, once erected, these platforms could not be easily and cheaply disassembled and reassembled at different locations. During disassembly, there were again extensive requirements for costly skilled labor, and these labor costs sometimes made it economically impractical to disassemble and subsequently reassemble a platform at a different location. As a result, known platforms were often left standing or simply demolished at the first location, and entirely new platforms were erected at a new location.

SUMMARY OF THE INVENTION

It is an object of this invention to provide a new and improved platform structure and method of assembling the platform structure.

The platform structure of the present invention includes a plurality of prefabricated column assemblies which are removably mountable with a platform foundation. Prefabricated landing assembly means are removably mountable on the column assemblies to form a landing above the column assemblies, and a prefabricated stair assembly is removably mounted between the platform foundation and the landing assembly means to form a passageway permitting ingress and egress to and from the landing.

Preferably, a position indicator is placed on each of the column assemblies to indicate the mounted position of the column assembly with respect to the mounted position of at least one other column assembly. After the components of the platform have been transported to a construction site, assembly of the platform is carried out by mounting diagonal braces on column assemblies and removably anchoring the column assemblies on the platform foundation in accordance with the position indicators. A crane or other suitable lifting device is employed to initially position some of the column assemblies in their mounted position, and anchor bolts or other mounting means are used to removably mount each column assembly on the foundation while the crane temporarily holds the column assembly being anchored in its mounted position. A landing assembly is then lifted with the crane into a mounted position over a selected pair of the column assemblies. Bolts or other suitable devices are employed to removably mount the landing assembly with the selected pair of column assemblies while the crane temporarily holds the landing assembly in its mounted position over the selected column assemblies. Column assemblies and landing assemblies are successively mounted in this manner until the platform attains its desired length.

Once at least one of the landing assemblies has been mounted over a selected pair of column assemblies, a stair assembly may then be lifted and temporarily held by the crane in an inclined position between the landing assembly and the platform foundation. Bolts or other suitable means are used to removably mount the stair assembly between the landing assembly and the platform foundation to form a stairway leading to the landing formed by the landing assembly.

The prefabricated characteristic of the components of the platform structure permit rapid assembly of the platform at the construction site. This feature also permits the platform to be constructed to the desired length by employing as many or as few of the column assemblies and landing assemblies as desired. The ease with which the platform assembly may be constructed is also aided by the removable mounting of the platform components with each other. Additionally, the removable mounting reduces the amount of skilled labor required and thereby reduces the construction costs considerably. Further, since the major elements of the platform assembly are removably mounted with one another, the platform structure of the present invention may be readily disassembled and subsequently installed at a new location. A further advantage is that with each individual component being hot dipped galvanized before being bolted to another component, the protective coating is not destroyed as it is in those cases where galvanized parts are welded together in the field.

DETAILED DESCRIPTION OF THE PREFERRED EMBODIMENTS

Figure 1:
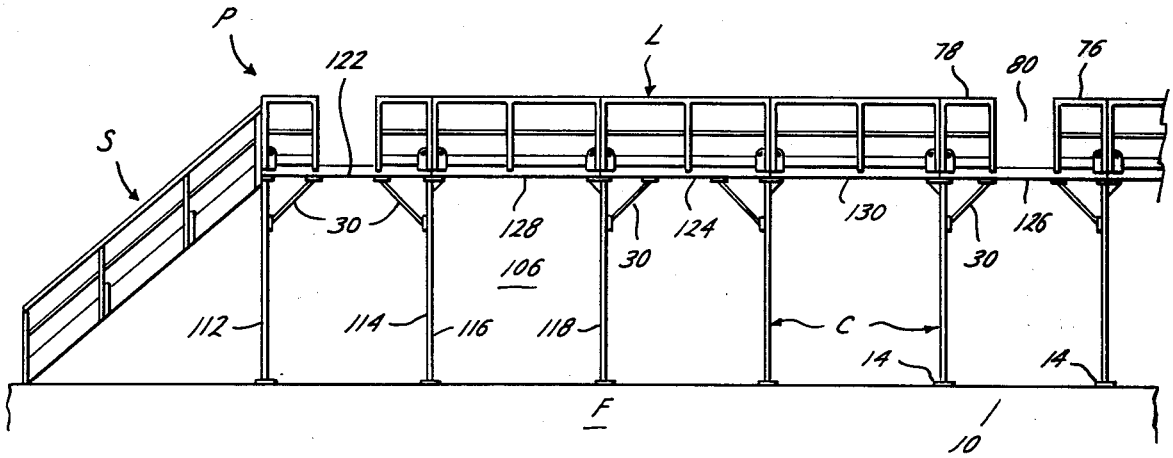
FIG. 1 illustrates a partial side view of the platform structure of the present invention.
Figure 3:
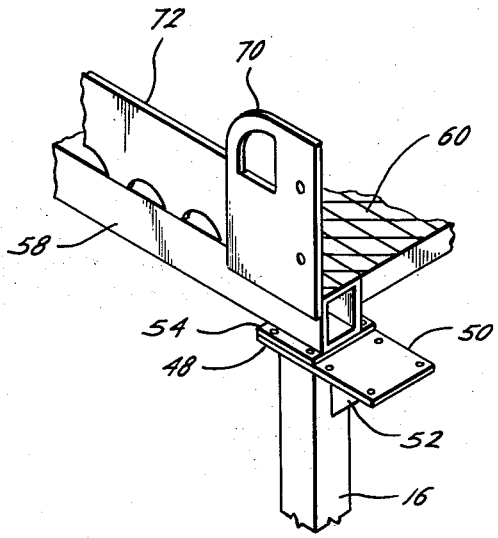
FIG. 3 is a perspective view illustrating a portion of a landing assembly and a portion of a column assembly in their mounted positions.

In the drawings, the letter P indicates the platform structure of the present invention which includes a plurality of column assemblies C mountable with a platform foundation F, landing assembly means L mountable with the column assemblies C, and a stair assembly S mounted between the landing assembly means L and the platform foundation F.

Figure 2:
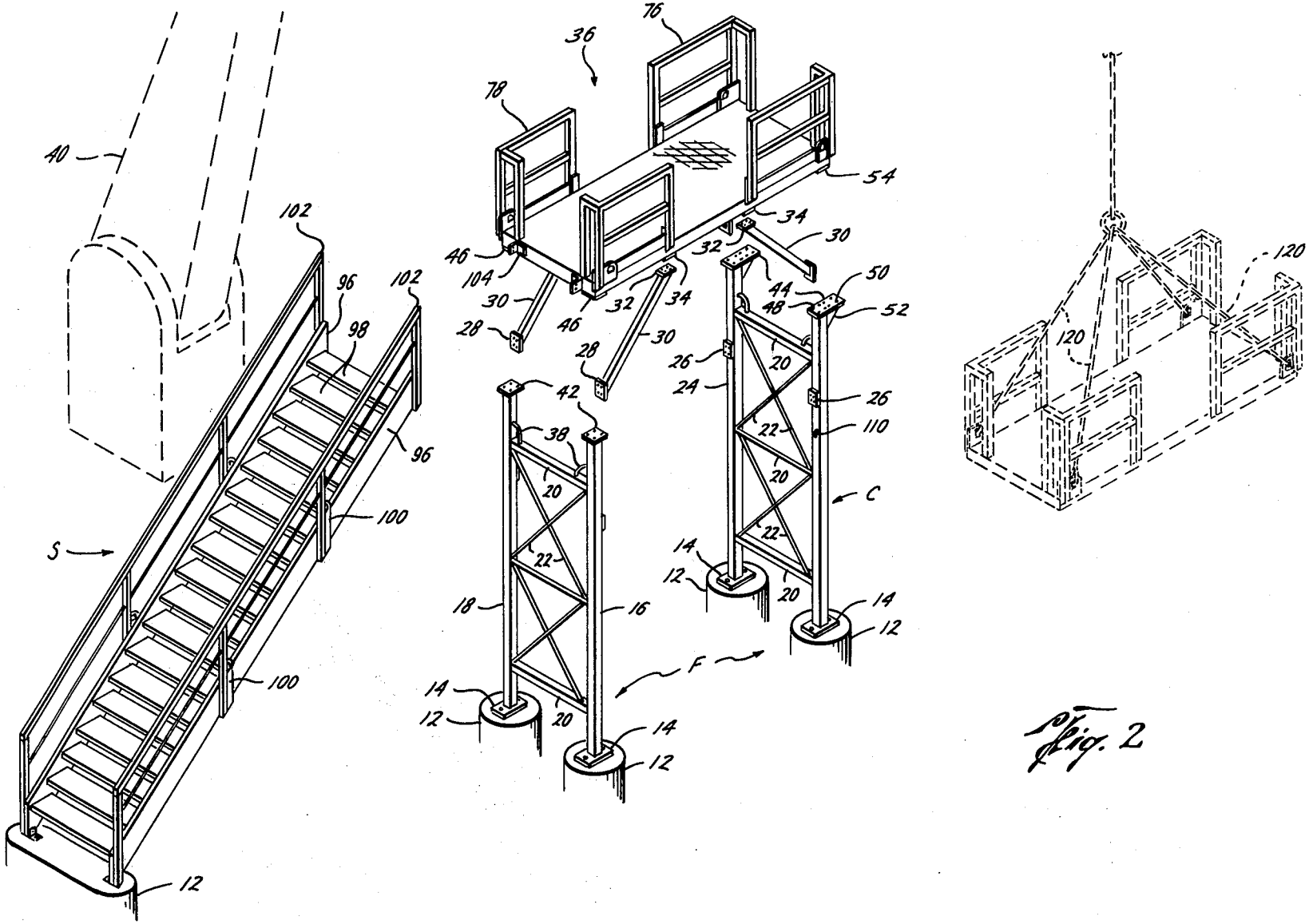
FIG. 2 is an exploded perspective view of various components of the present invention and additionally illustrates a part of the assembly method of the present invention.

Considering the invention in more detail, the platform structure P of the present invention is suitable for use in a wide variety of situations. One example of its use is in rail yard loading or inspection stations adjacent the railroad tracks. The platform structure P is readily adapted for use with a variety of types of foundations which may easily be constructed at such locations. For example, the foundation F may be a simple concrete slab foundation 10 as illustrated in FIG. 1, or a foundation including a plurality of concrete supports 12 as illustrated in FIG. 2. Preferably, the foundation F has a suitable connecting structure such as anchor bolts to which feet 14 of the column assemblies C may be bolted or otherwise removably affixed.

Each of the column assemblies C includes a pair of upright members 16 and 18 joined by lateral braces 20 and sway braces 22. On one surface 24 of each of the upright member 16 and 18 there is mounted a connector plate 26. The connector plate 26 has a plurality of holes extending through it, and the holes in connector plate 26 can be aligned with similar holes in a mating connector plate 28 of a diagonal brace 30 so that bolts may be extended through the mating connector plates 26 and 28 to removably mount the diagonal brace 30 with the column assembly C. The diagonal brace 30 has another connecting plate 32 at the end of the brace opposite plate 28 which also has holes in it alignable with holes in a connector plate 36 of landing assembly 34 so that the mating connector plates 32 and 34 may be bolted together.

The column assemblies C additionally include a pair of lifting lugs 38, each of which is mounted between one of the uprights and the upper lateral brace 20. The lifting lugs 38 are of a size and configuration suitable for lifting the assemblies C with a crane schematically illustrated at 40.

Each of the column assemblies C is identical in structure and function except that the exterior column assemblies have landing connector plates 42 which differ in structure from the landing connector plates 44 of the interior column assemblies. As shown in FIG. 2, the landing connector plates 42 of the exterior column assemblies are generally rectangular in configuration and substantially centered over the upright member to which they are affixed. Holes extend through the landing connector plates 42 and may be aligned with similar holes extending through connector plates 46 of the landing assemblies so that the plates 42 and 46 may be bolted together to mount the landing assemblies 36 with the exterior column assembly. The interior column assemblies have landing mounting plates 44 which have a first section 48 extending substantially over the upright member and a second section 50 extending outwardly from the longitudinal axis of the upright with which they are mounted. A support gusset 52 is affixed to the upright and the extension 50 to provide support for the extension 50. The first section 48 of the interior landing connector plate 44 has holes extending through it which may be aligned with holes extending through a mating connector plate 54 on the landing assembly 36. Additionally, the extension 50 of connector plate 44 has holes extending through it which are adapted to be aligned with a connector plate 46 of a second landing assembly. Bolts or other suitable means are used to removably mount the second landing assembly with the extension 50 of the landing connector plate 44. Thus, the landing connector plates 44 of the interior column assemblies are mounted with two adjacent landing assemblies.

The column assemblies C are prefabricated units and are preferably transported to the construction site as such. The feet 14, lateral braces 20, sway braces 22, connector plates 26, lifting lugs 38, and connector plates 42 or 44 are welded or otherwise permanently affixed to their adjacent structure in a fabricating shop or other suitable location at a time prior to transporting the unit to the actual construction site for the platform P.

Preferably, two types of landing assemblies are used with the platform P of the present invention. The first is a walkway landing assembly 56 illustrated in FIG. 4. The second landing assembly is a working or loading assembly 36 illustrated in FIG. 5.

The walkway landing assembly 56 includes longitudinally extending stringers 58 between which is welded or otherwise permanently affixed a grating 60. The landing assembly 56 has connector plates 46 and 54 permanently affixed to the stringers 58 for mounting with column assemblies C as previously described with reference to the working landing assembly 36. Connector plates 34 are also permanently affixed to the stringers 58 for mounting with diagonal braces 30. Also permanently affixed to each of the stringers 58 are a plurality of plates 62. Each of the plates 62 forms an anchor 64 for receiving one of the vertical members 66 of a handrail 68. Holes extend through each of the plates 62 and through the vertical members 66 of handrail 68 so that with the vertical members 68 extending beside the plate 62, the holes in the handrail vertical members 66 and plates 62 can be aligned. Bolts may then be used to mount the handrails 68 with the landing assembly 56.

Lifting lugs 70 are permanently affixed, such as by welding, to each of the stringers 58 so that a lifting lug is located near each of the corners of the landing assembly 56. As illustrated in FIG. 2, and as described in more detail hereinbelow, the lifting lugs are elements by which a crane 40 may be used to lift the platform 56 into place for mounting on column assemblies C.

Toe plates 72 are also permanently affixed to each of the stringers 58 and extend longitudinally along the length of the landing assembly 56. As illustrated, the toe plates 72 extend vertically above the surface of the grating 60 and form a barrier which reduces the probability of an accident due to a worker on the grating extending his foot beyond the edge of the grating in such a manner that he might lose his footing and injure himself.

Figures 4, 5:
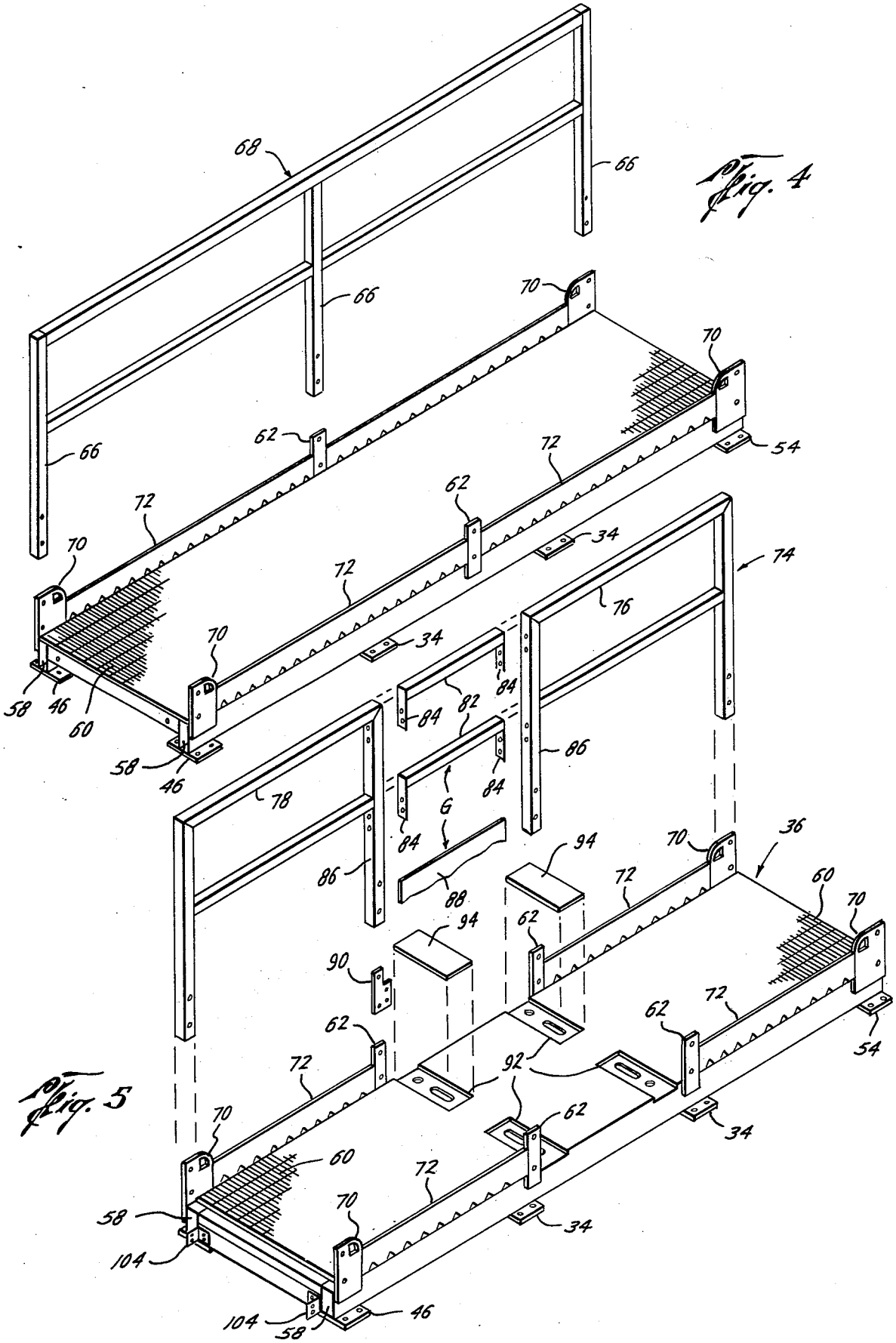
FIG. 4 is a perspective view of one of the landing assemblies of the present invention.
FIG. 5. is a perspective view of a second landing assembly of the present invention.

The working landing assembly 36 illustrated in FIG. 5 has many components which are identical in structure and function to the components previously described above with respect to the walking landing platform 56. Accordingly, like numerals are used to indicate like elements in FIGS. 4 and 5.

The principal difference between the walking landing assembly 56 and the working landing assembly 36 is that the latter assembly is adapted to have a removable gate and receive a laterally extending bridge permitting access to a railroad car or other device adjacent to the platform P.

The handrail 74 of the working assembly 36 preferably comprises two sections 76 and 78 on each side of the assembly 36. Each of the sections 76 and 78 extends to a corner of the landing assembly 36 and is mounted on plate 62 in a manner identical to that described above with reference to the handrail 68. However, the handrail sections 76 and 78 are abbreviated longitudinally so that they do not extend to the center of the working assembly 36. An opening 80 is left between the handrail sections 76 and 78. A removable gate assembly G may be installed in opening 80 if desired, such as at times when the platform P is not actually in use. The removable gate G includes longitudinally extending rails 82, each having downwardly extending flanges 84 at its ends. The flanges 84 have holes extending therethrough which may be aligned with mating holes in vertical members 86 of the handrail 74 so that the rails 82 are bolted and thereby removably mounted with the handrail assembly. Additionally, a removable toe guard 88 may be bolted to the stringers 58 by bolts extending through a toe guard bracket 90 (only one of which is illustrated) and into the stringers 58.

The working platform is also provided with a plurality of recesses 92 in the grating 60 to receive a lateral extension, such as the bridge of another of my inventions identified by file number A-71365 in the offices of Pravel & Wilson, 2010 Marathon Building, Houston, Tex. Cover plates 94 may also be provided to fit into the recesses 92 and thereby cover the recesses when the bridge is not being utilized.

Preferably, both the walking landing assembly 56 and the working assembly landing 36 are prefabricated units, the permanently affixed parts of which are welding or otherwise suitably joined at a fabricating shop prior to transporting the assemblies in a construction area. At the construction site, only the removably mounted parts, such as the handrails, removable gate, and laterally extending bridge need be installed to either of the landing assemblies. 56 and 36.

A prefabricated stair assembly S is also provided with platform P. The prefabricated stair assembly includes a pair of stringers 96 between which are welded a plurality of treads 98. Lifting lugs 100 are welded to each of the stringers 96 as are plates (not shown) substantially identical in structure to the plate 62 of the landing assemblies. Handrails 102 may be bolted or otherwise removably mounted in the sleeves of the stair assembly S in a manner identical to that described above with reference to the landing asembly handrails.

The stair assembly S is preferably bolted to a landing assembly 36. Mounting flanges 104 are bolted to the landing assembly 36 and extend longitudinally outward therefrom to be bolted to mating flanges (not shown) permanently affixed to the stair assembly S. The stair assembly S is also removably mounted to the foundation 12, preferably with anchor bolts.

Assembly of the platform structure P can be accomplished rapidly and with the use of a minimum of skilled labor. After the components of the platform structure are transported to and stacked at the construction site, two diagonal braces 30 are first bolted to an end column assembly C. At this time, diagonal braces 30 may also be bolted to one or more of the interior column assemblies. A crane is utilized to lift the column assemblies C into a position on the foundation F so that the feet 14 of the column assemblies can be anchored to the foundation. While the feet 14 are being bolted to the foundation F, the crane holds the column assembly in position.

It will be appreciated that the column assemblies C have specific mounted positions with respect to each other. As illustrated in FIG. 1, it is preferred that the connecting plates 26 of pairs of column assemblies face one another so that entire sets of four diagonal braces 30 are arranged in alternate bays. Further, with the interior column assemblies, it is preferred that lateral extensions 50 of pairs of column assemblies extend toward one another as illustrated in bays 106 and 108 of FIG. 1.

To facilitate the proper handling and positioning of the column assemblies C, it is preferred that a position indicator, designated generally as 110, be placed on each column assembly prior to the time that the column assemblies are erected. The position indicator 110 may be a decal, a painted emblem, or other suitable marking indicating the proper mounted position of the column assembly with respect to another column assembly. For example, the position indicator 110 on faces 112 and 114 of the uprights of adjacent column assemblies as illustrated in FIG. 1 may bear the indicator "A". The opposing faces 116 and 118 of the next adjacent pair of column assembly uprights may bear the indicator "B". Similar matched indicators are preferably positioned on each of the subsequent column assemblies to ensure the proper positioning of the assemblies throughout the length of the platform P.

Prior to the mounting of the landing assemblies on adjacent pairs of the column assemblies, handrails are bolted to the landing assemblies. Also, if the landing assembly is a working landing assembly 36, a removable gate G may be bolted in place if desired. The landing assembly is then lifted with the crane 40 utilizing the lifting lugs 70 at each of the four corners of the landing assembly. Preferably, as illustrated in FIG. 2, the cables 120 extending to the lifting lugs 70 are of equal length so that the landing platform is raised with the grating 60 in a substantially horizontal plane. The platform is positioned over a pair of adjacent column assemblies C, the holes in the connector plates of the landing assembly and of the column assemblies are aligned, and the landing assembly is bolted to the column assembly while crane 40 temporarily holds the landing assembly in place. Additionally, the diagonal braces 30 may be bolted to the landing assembly at this time if diagonal braces are to be used in the particular bay being assembled.

It should be noted that with the structure and assembly procedure described above, alternate landing assemblies are mounted with column assemblies such that the ends of the landing assemblies extend substantially over the uprights of each of the column assemblies with which the landing assembly is mounted. For example, landing assemblies 122, 124, and 126 illustrated in FIG. 1 are mounted so that the ends of these landing assemblies extend over the uprights of the pair of column assemblies with which they are mounted. On the other hand, landing assemblies 128 and 130 which are interposed between landing assemblies 122, 124, and 126 are not mounted so that the ends of these former assemblies extend over the uprights of the column assemblies with which they are mounted. Rather, landing assemblies 128 and 130 are mounted to the extensions 50 of the interior column assemblies and therefore extend between the column assembly uprights with which they are mounted. The ends of the assemblies 128 and 130 do not extend over those uprights.

After the mounting of an end landing assembly such as 122, the stair assembly S may be mounted with the platform P. Crane 40 is utilized to lift the stair assembly S into its mounted position between the landing platform 122 and the foundation F. In lifting the stair assembly, it is preferable to use lifting cables of unequal length so that that stair assembly S is lifted with the stringers 96 at an incline. In this manner, the crane 40 may be used to hold the stair assembly S in its mounted position while the stair assembly is bolted to the landing assembly 122 and the foundation F.

It should be understood, of course, that more than one stair assembly can be used with the platform structure P.

As is evident from the above description, the platform P can take many forms other than that specifically illustrated in FIG. 1. For example, the platform can be constructed to many different lengths. In its shortest form, the platform structure of the present invention would comprise only two column assemblies C, one landing assembly 36, and a stair assembly S. However, due to the prefabricated characteristics of elements of the platform P, the platform may be extended over long distances by utilizing additional column assemblies and landing assemblies. Additionally, if desired, the working landing assemblies 36 may be constructed with an overhang grating which is wider than the grating of the walking platforms 56. In this manner, additional space is provided on the working landing platforms to facilitate loading and unloading procedures.

The foregoing disclosure and description of the invention are illustrative and explanatory thereof, and various changes in the size, shape, and materials as well as in the details of the illustrated construction may be made without departing from the spirit of the invention.

I claim:

1. A platform structure adapted for rapid assembly and disassembly over a platform foundation, comprising:

a plurality of prefabricated column assemblies;

column mounting means for removably mounting said column assemblies on a platform foundation;

prefabricated landing assembly means mountable with said column assemblies for forming a landing above said column assemblies;

landing assembly mounting means for removably mounting said landing assembly means with said column foundation and wherein said landing assembly means includes a plurality of landing assemblies, each mountable with a selected pair of column assemblies;

said column assemblies include upright members;

said landing assembly mounting means includes:

means for mounting at least one of said landing assemblies with the ends of said landing assembly extending substantially over said upright members of a pair of said column assemblies; and means for mounting at least one of said landing assemblies with the ends of said landing assembly extending substantially to but not over the ends of said upright members of a pair of said column assemblies;

a prefabricated stair assembly mountable between said landing assembly means and the platform foundation; and stair mounting means for removably mounting said stair assembly between said landing assembly means and the platform foundation.

* * * * *